United States Patent [19]

Manserra

[11] Patent Number: 4,852,259

[45] Date of Patent: Aug. 1, 1989

[54] STRAIGHT EDGE CUTTER GUIDE

[76] Inventor: Pasquale M. Manserra, 656 Pharmacy Avenue, Scarborough, Ontario, Canada, M1L 3H5

[21] Appl. No.: 165,255

[22] Filed: Mar. 7, 1988

[51] Int. Cl.[4] ..... B26D 7/20

[52] U.S. Cl. ..... 30/289; 30/286; 7/163

[58] Field of Search ..... 30/286, 287, 289, 291, 30/294; 7/105, 163; 33/382, 390, 379

[56] References Cited

U.S. PATENT DOCUMENTS

| | | | |
|---|---|---|---|
| 189,825 | 4/1919 | Spangler . | |
| 2,263,311 | 4/1941 | Ream | 30/287 |
| 2,373,641 | 4/1945 | Ackerson . | |
| 2,562,127 | 7/1951 | Sand . | |
| 3,820,249 | 6/1974 | Stone . | |
| 3,862,494 | 1/1975 | Andersson | 30/289 |
| 4,095,340 | 6/1978 | Kingsley | 30/287 |
| 4,593,475 | 6/1986 | Mayes . | |

FOREIGN PATENT DOCUMENTS

| | | | |
|---|---|---|---|
| 3202335 | 8/1982 | Fed. Rep. of Germany | 30/289 |

*Primary Examiner*—Frank T. Yost
*Assistant Examiner*—Michael D. Folkerts
*Attorney, Agent, or Firm*—Fetherstonhaugh & Co.

[57] ABSTRACT

A straight edge cutter guide for use when cutting a web such as wallpaper after it has been hung on a support surface which is normal to or inclined with respect to the horizontal plane comprises a blade, a handle and spirit level indicators. The blade is rigid and has a straight edge extending longitudinally along one edge thereof. The bottom face is flat and has a sufficient area to provide a stable base for the cutter guide. The handle is mounted on said base and has a hand grip portion located above the top face. The hand portion is accessible for use when retaining the base in any required position with its bottom face bearing against a web in use. The level indicators are mounted on the cutter guide so as to be visible when said bottom face is operably located. The level indicators are arranged in a predetermined relationship with respect to the straight edge to provide a visible indication of the orientation of the straight edge with respect to the horizontal plane when the bottom face is held against the surface of a web in use.

2 Claims, 2 Drawing Sheets

STRAIGHT EDGE CUTTER GUIDE

This invention relates to a straight edge cutter guide for use when cutting or trimming wallpaper or the like.

PRIOR ART

It is frequently necessary to trim wallpaper or the like after it has been hung in order to provide a straight, vertical edge or an angularly inclined edge.

Despite the fact that a wide variety of tools are presently available to assist both professional and home decorators in the hanging of wallpaper, no tool is presently available which can be easily held against an upright wall surface and which will permit the user to determine when the straight edge associated therewith is located in a predetermined plane.

It is an object of the present invention to provide a simple and inexpensive straight edge cutter guide which incorporates level indicator means which serve to indicate the orientation of the straight edge of the guide.

According to one aspect of the present invention, there is provided a straight edge cutter guide for use when cutting a web such as wallpaper after it has been hung on a support surface which is normal to or inclined with respect to the horizontal plane comprising a substantially rigid blade having a top face, a bottom face, and a straight edge extending longitudinally along one edge thereof, said bottom face being flat and having a sufficient area to provide a stable base for the cutter guide, a handle mounted on said base, said handle having a hand grip portion located above said top face which is accessible for use when retaining the base in any required position with its bottom face bearing against a web in use and level indicator means mounted on said cutter guide so as to be visible when said bottom face is operably located, said level indicator means being arranged in a predetermined relationship with respect to said straight edge to provide a visible indication of the orientation of the straight edge with respect to the horizontal plane when the bottom face is held against the surface of a web in use.

Figure 1:
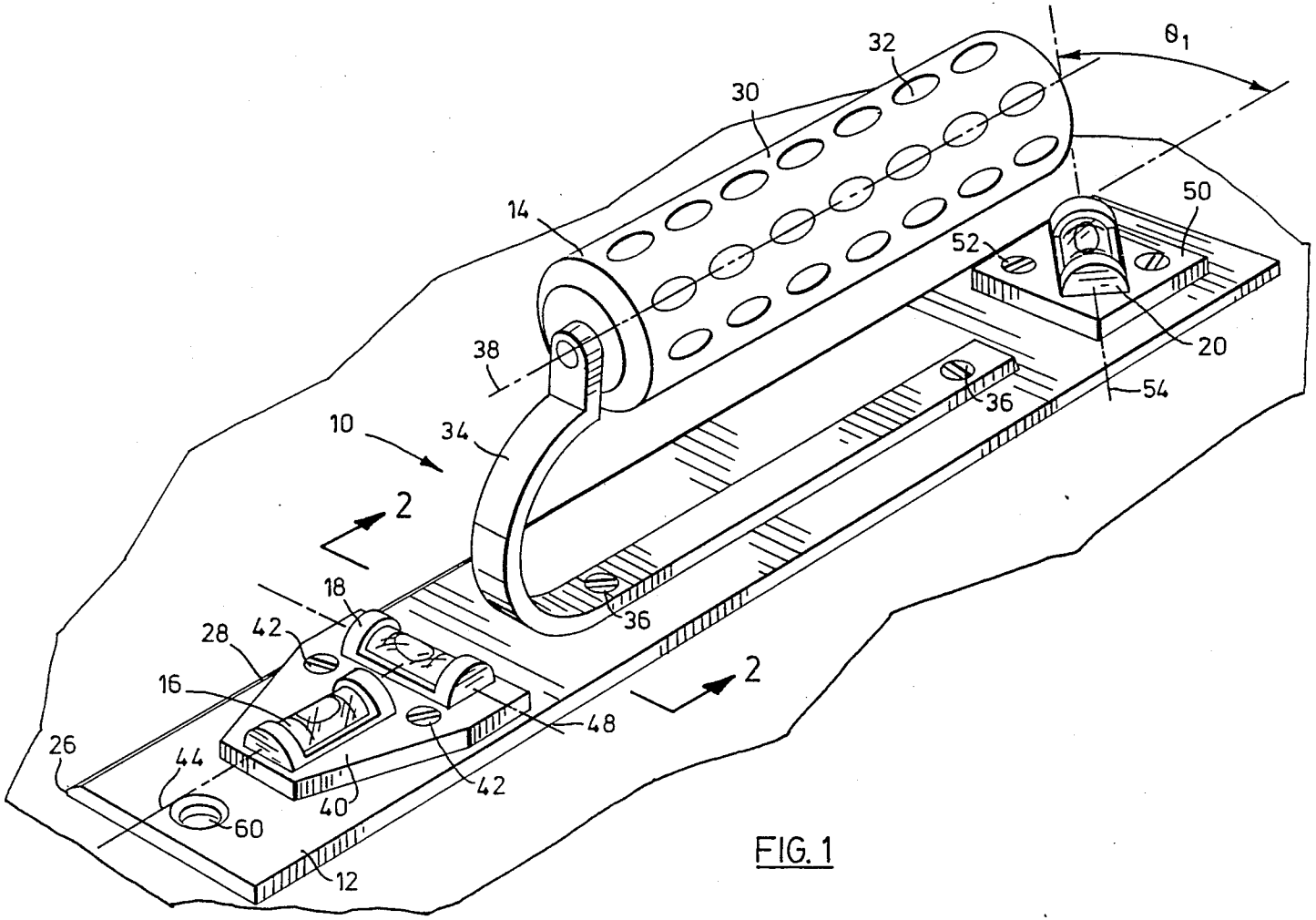
Figure 2:
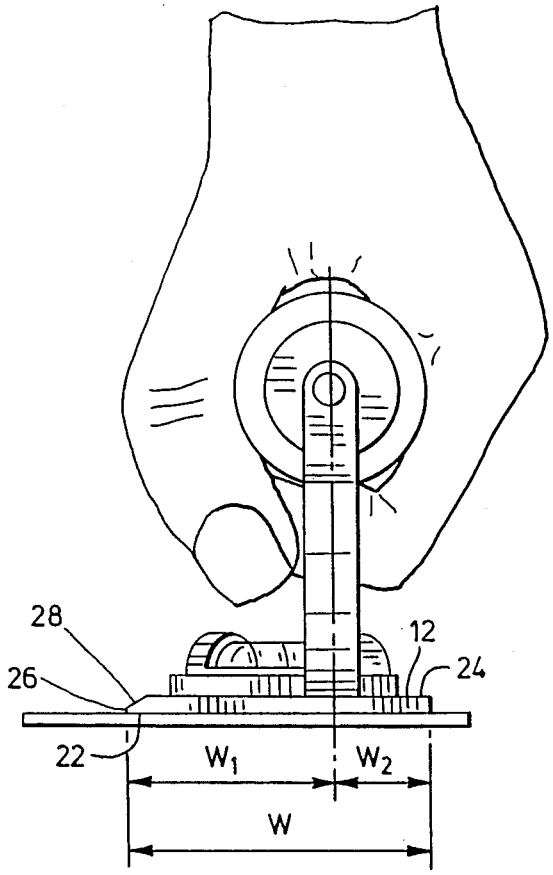

The invention will be more clearly understood after reference to the following detailed specification read in conjunction with the drawings wherein;

FIG. 1 is a pictorial view of a cutter guide constructed in accordance with an embodiment of the present invention, FIG. 2 is a sectional side view taken along the line 2—2 of FIG. 1.

With reference to FIG. 1 of the drawings, the reference numeral 10 refers generally to a straight edge cutter guide constructed in accordance with an embodiment of the present invention. The straight edge cutter guide 10 has a rigid blade member 12, a handle 14 and spirit level indicators 16, 18 and 20.

The blade 12 is formed from a rigid strap of metal, plastics or the like and has a flat bottom face 22 and an upper face 24. A straight edge 26 extends along one edge of the bottom face 22. The blade 12 is formed with a chamfer 28 which extends from the top face 24 to the straight edge 26. The chamfer angle is preferably about 45° with respect to the bottom face 22 such that the straight edge 26 is sharpened to provide a cutting edge.

The handle 14 has an elongated hand grip portion 30 which is contoured to provide a plurality of finger grooves 32 which are arranged at spaced intervals along the length thereof. The hand grip portion 30 is supported above the top face 24 of the blade by means of a handle mounting bracket 34, one end of which is embedded in the hand portion and the other end of which is secured to the blade 12 by means of mounting screws 36. The handle portion 30 has a longitudinal axis 38 which is arranged to extend parallel to the straight edge 26. The hand grip portion 30 is spaced a sufficient distance above the upper face 24 to provide sufficient clearance to enable the user to encircle the handle when it is grasped in use.

The first and second spirit levels 16 and 18 are each mounted in a carrier 40 which is in turn secured to the blade 12 by means of mounting screws 42. The longitudinal axis 44 of the spirit level 16 is arranged to extend parallel to the straight edge 26 in a plane which is parallel to the bottom face 22 of the blade. The longitudinal axis 48 of the spirit levels 18 is arranged to extend at right angles to the straight edge 26 in a plane which extends parallel to the bottom face 22.

The spirit level 20 is mounted in a base 50 which is secured to the blade 12 by mounting screws 52. The longitudinal axis 54 of the spirit level 20 is arranged to extend at an angle $\theta_1$ with respect to the straight edge 26 and to extend in a plane which is parallel to the plane of the bottom face 22. Preferably, the angle $\theta_1$ is a 45° angle.

Preferably, the blade 12 has a width W which measures about 2" and a length of about 14". A relatively narrow blade in desirable because there are many locations in which this straight edge cutter device is useful which are very restricted. Because it is important to ensure that the straight edge 26 is clearly visible when the cutting cutter blade is in use, the handle portion 30 is preferably laterally offset such that the distance W1 from the edge 26 to the center line of the handle is greater than the width W2. Preferably, the width W1 measures about 1½" while the width W2 measures about ½". The hand grip portion of the handle preferably has a diameter of about 1¼" and the longitudinal axis 38 is spaced above the top face by about 2".

For the purposes of hanging the straight edge cutter guide from a support pin or rod when it is stored, I provide an aperture 60 at one end of the blade 12.

In use, the straight edge cutter guide is placed on the surface of the web which is to be cut or marked with the bottom face 22 bearing against the web 62. It will be apparent that the web may be vertically oriented or angularly inclined with respect to the horizontal plane. The straight edge 26 is positioned so as to be vertically oriented and vertical alignment can be determined by visually examining the spirit level 18. This will permit cutting or marking of the web along the straight edge 26 when it is vertically oriented. The spirit level 16 is used for the purposes of setting the straight edge so that it extends horizontally. The spirit level 20 is used for the purposes of setting the straight edge at an angle $\theta_1$.

Various modifications of the present invention will be apparent to those skilled in the art. For example, in a device which is only intended for use when the straight edge is vertically oriented, the spirit levels 16 and 20 may be omitted. Similarly, if the device is only intended to be used with the straight edge 26 horizontally oriented, the spirit levels 18 and 20 may be omitted.

I claim:

1. A straight edge cutter guide for use when cutting a web such as wallpaper after it has been hung on a support surface which is normal to or inclined with respect to the horizontal plane comprising;

(a) a substantially rigid blade having a top face, a bottom face, and a straight edge extending longitudinally along one edge thereof, said straight edge being sharpened to provide a cutting edge, said bottom face being flat so as to distribute loads which are applied to it in use across a wide area, said bottom face having a sufficient area to provide a stable base for the cutter guide, (b) a handle attached directly to and located directly above said base, said handle having a hand grip portion located above said top face which is accessible for use when retaining the base in any required position with its bottom face bearing against a web in use, and (c) level indicator means mounted on said top face of said blade so as to be visible when said bottom face is operably located, said level indicator means being arranged in a predetermined relationship with respect to said straight edge to provide a visible indication of the orientation of the straight edge with respect to the horizontal plane when the bottom face is held against the surface of a web in use

2. A straight edge cutter guide for use when cutting a web such as wallpaper after it has been hung on a support surface which is normal to or inclined with respect to the horizontal plane comprising;

(a) a substantially rigid blade having a top face, a bottom face, and a straight edge extending longitudinally along one edge thereof, said bottom face being flat so as to distribute loads which are applied to it in use across a wide area, said bottom face having a sufficient area to provide a stable base for the cutter guide, (b) a handle attached directly to and located directly above said base, said handle having a hand grip portion located above said top face which is accessible for use when retaining the base in any required position with its bottom face bearing against a web in use, and (c) level indicator means mounted on said top face of said blade so as to be visible when said bottom face is operably located, said level indicator means being arranged in a predetermined relationship with respect to said straight edge to provide a visible indication of the orientation of the straight edge with respect to the horizontal plane when the bottom face is held against the surface of a web in use, (d) said blade having a second longitudinal edge and said hand grip portion of said handle having a longitudinal axis which extends parallel to said straight edge, said hand grip portion of said handle being laterally offset toward said second longitudinal edge so as to be located more closely adjacent the second longitudinal edge than the first longitudinal edge so that it does not obscure the user's direct line of vision to the straight edge to facilitate alignment of the straight edge with a predetermined marking on the underlying web in use.

* * * * *